US007926186B2

(12) United States Patent
McLoughlin et al.

(10) Patent No.: US 7,926,186 B2
(45) Date of Patent: Apr. 19, 2011

(54) RELEASABLE PIKE POLE

(76) Inventors: John E. McLoughlin, Lake Grove, NY (US); Neocles G. Athanasiades, Setauket, NY (US); Toh M. Meng, Hauppauge, NY (US)

( * ) Notice: Subject to any disclaimer, the term of this patent is extended or adjusted under 35 U.S.C. 154(b) by 622 days.

(21) Appl. No.: 11/260,550

(22) Filed: Oct. 28, 2005

(65) Prior Publication Data

US 2007/0094875 A1 May 3, 2007

(51) Int. Cl.
*B26B 13/00* (2006.01)

(52) U.S. Cl. ..... 30/244; 30/245; 30/246; 30/249; 30/250; 30/251; 30/296.1

(58) Field of Classification Search ..... 30/244–246, 30/248–251, 254, 296.1; 56/239, 241, 332, 56/333, 335; D8/4, 5, 7
See application file for complete search history.

(56) References Cited

U.S. PATENT DOCUMENTS

| | | | | | |
|---|---|---|---|---|---|
| 646,048 | A | * | 3/1900 | Donzella | 30/251 |
| 1,254,284 | A | * | 1/1918 | Southwood | 30/248 |
| 1,374,768 | A | * | 4/1921 | Ruppert | 30/249 |
| 1,378,791 | A | * | 5/1921 | Johanson | 30/251 |
| 1,632,479 | A | * | 6/1927 | Huberty | 56/241 |
| 1,823,199 | A | * | 9/1931 | Huxman | 30/248 |
| 1,833,535 | A | * | 11/1931 | Rossman | 56/241 |
| RE21,347 | E | * | 2/1940 | Goodman | 30/249 |
| 2,246,730 | A | * | 6/1941 | Hafdell | 30/251 |
| 2,504,164 | A | * | 4/1950 | Sundstrand | 56/241 |
| 2,547,433 | A | * | 4/1951 | Barnett | 56/241 |
| 2,631,369 | A | * | 3/1953 | Carnesecca, Jr. | 30/249 |
| 2,648,903 | A | * | 8/1953 | Hulse | 30/248 |
| 2,776,535 | A | * | 1/1957 | Branske | 30/246 |
| 2,777,196 | A | * | 1/1957 | Zoetemelk | 30/248 |
| 2,827,694 | A | * | 3/1958 | Trippler | 30/250 |
| 2,989,334 | A | * | 6/1961 | Browne | 56/333 |
| 2,993,275 | A | * | 7/1961 | Naito | 30/250 |
| 2,994,954 | A | * | 8/1961 | Thompson | 30/251 |
| 3,039,189 | A | * | 6/1962 | McBerty | 30/245 |
| 3,138,869 | A | * | 6/1964 | Parhaniemi | 30/250 |
| 3,624,903 | A | * | 12/1971 | Tibbet | 30/238 |
| 3,826,160 | A | * | 7/1974 | Allen et al. | 81/418 |
| 4,458,418 | A | * | 7/1984 | McSmith et al. | 30/249 |
| 4,506,445 | A | * | 3/1985 | Esten | 30/228 |
| 4,696,107 | A | * | 9/1987 | Held | 30/246 |
| 4,734,983 | A | * | 4/1988 | Brick | 30/249 |
| 4,841,641 | A | * | 6/1989 | Laidlaw | 30/382 |
| 4,949,461 | A | * | 8/1990 | van der Merwe et al. | 30/245 |
| 4,965,992 | A | * | 10/1990 | Jacobs | 56/241 |
| 5,084,975 | A | * | 2/1992 | Melter | 30/249 |
| 5,282,315 | A | * | 2/1994 | Martin | 30/251 |
| 5,341,572 | A | * | 8/1994 | Michelson | 30/249 |
| 5,347,800 | A | * | 9/1994 | Morgan | 56/335 |
| 5,375,401 | A | * | 12/1994 | Flickinger | 56/239 |
| 5,894,667 | A | * | 4/1999 | Van Den Hout | 30/249 |
| 5,950,315 | A | * | 9/1999 | Linden | 30/249 |
| 5,996,232 | A | * | 12/1999 | Lin | 30/250 |
| 6,643,935 | B1 | * | 11/2003 | Lowe et al. | 30/252 |
| 6,901,665 | B2 | * | 6/2005 | Sun et al. | 30/249 |
| 6,935,031 | B1 | * | 8/2005 | Huang | 30/250 |

(Continued)

*Primary Examiner* — Jason Daniel Prone

(74) *Attorney, Agent, or Firm* — Wei Wei Jeang; Andrews Kurth LLP

(57) ABSTRACT

A pike pole has a cutting-piercing member connected to one end of the pole. The cutting member normally extends outwardly from the pike pole. The cutting member can be released by a controlling member and be pivotally moveable to a position extending generally along the piercing member.

19 Claims, 4 Drawing Sheets

U.S. PATENT DOCUMENTS 6,938,347 B2 * 9/2005 Linden et al. ..... 30/251
6,964,099 B1 * 11/2005 Zeng ..... 30/254
7,275,323 B2 * 10/2007 Yang ..... 30/244
7,346,991 B1 * 3/2008 Janson ..... 30/244
7,530,172 B1 * 5/2009 Wu ..... 30/244
7,677,619 B2 * 3/2010 Hutchings et al. ..... 56/333
2002/0124414 A1 * 9/2002 Yang ..... 30/254
2003/0061716 A1 * 4/2003 Chen ..... 30/296.1
2004/0194320 A1 * 10/2004 Hsieh ..... 30/250
2010/0299936 A1 * 12/2010 Chen ..... 30/251

* cited by examiner

RELEASABLE PIKE POLE

BACKGROUND OF THE INVENTION

1. Field of the Invention

The subject invention relates to a releaseable pike pole.

More particularly, the subject invention relates to a releaseable pike pole wherein the normally transversely extending cutting member is controllable moveable to a position generally extending along the longitudinal axis of the pike pole.

2. Description of Related Art Including Information Disclosed Under 37 CFR 1.97 and 1.98

A pike pole is one of the tools often used by fire fighters. The pike pole has a handle and a cutting-piercing member connected to one end of the handle. The firemen use the pike poles to stab through roofing material and siding and then cut and jerk away the roofing material and siding with the transversely extending cutting member of the cutting-piercing member.

Often the pike pole, once stabbed through the material to be removed, finds the transverse cutting member to be hung up on wires, bolts, or other objects within the structure. The pike pole is then difficult or impossible to remove and represents a waste of time, labor, and materials.

The subject invention is constructed to overcome one or more of the problems as set forth above.

BRIEF SUMMARY OF THE INVENTION

Pike poles have a handle, a longitudinal axis and a cutting-piercing member. The cutting-piercing member has a first element extending along the longitudinal axis and has a pointed tip.

An elongated cutting member is pivotally connected to the first element and is controllable moveable between a first position at which the cutting member extends generally transverse the longitudinal axis and a second position at which the cutting member extends generally along the longitudinal axis.

A controlling system is connected to the handle and is adjustable between a first position at which the cutting member is maintained at the cutting member first position and a second position at which the cutting member is released and pivotally moveable to the cutting member second position.

BRIEF DESCRIPTION OF THE SEVERAL VIEWS OF THE DRAWING(S)

DETAILED DESCRIPTION OF THE INVENTION

Figure 1:
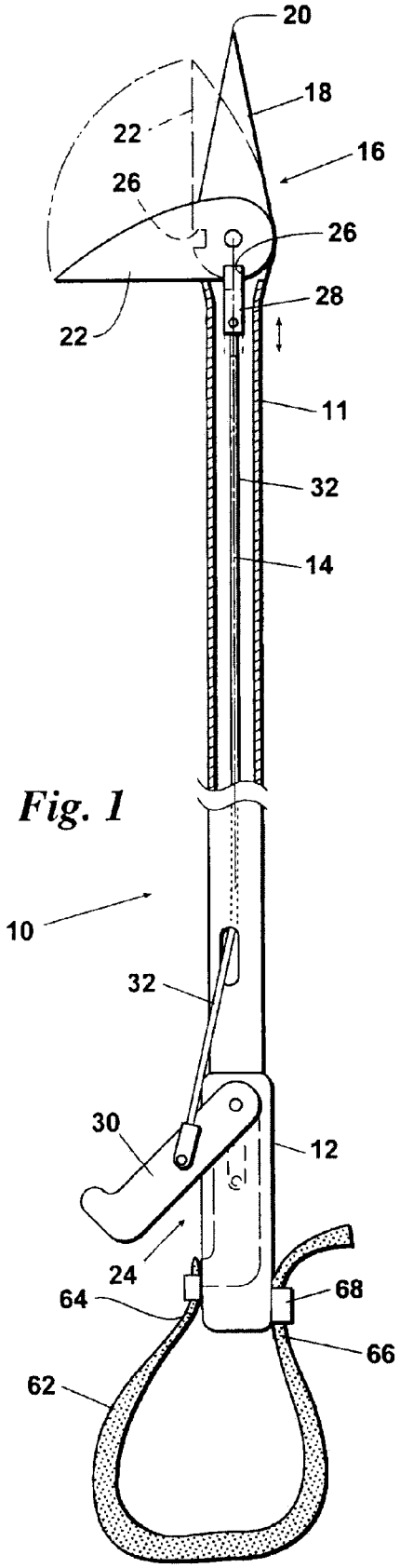
FIG. 1 is a side view of one embodiment of a pike pole of this invention.
Figure 2:
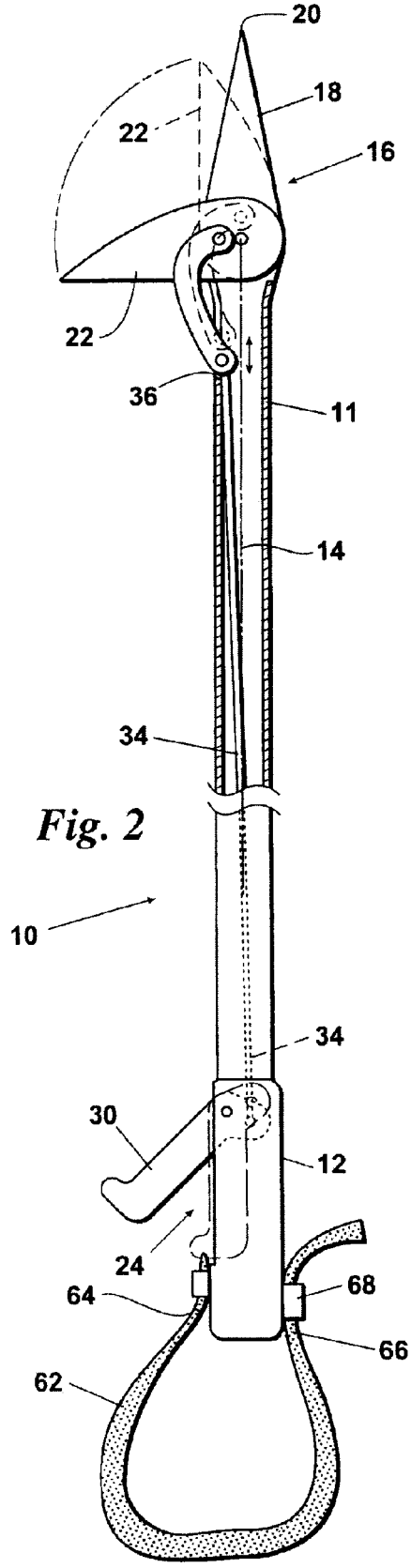
FIG. 2 is a side view of another embodiment of a pike pole of this invention.

Referring to FIG. 1-2, a pike pole 10 of this invention has a pole 11, a handle 12 connected to one end of the pole 11, a longitudinal axis 14 and a cutting-piercing member 16. The cutting-piercing member 16 has a first element 18 extending along the longitudinal axis 14 and being connected to the other end of the pole 11. The first element 18 has a pointed tip 20.

An elongated cutting member 22 is pivotally connected by a bolt, for example, to the first element 18. The cutting member 22 is controllably moveable between a first position at which the cutting member 22 extends transverse the longitudinal axis 14 and is maintained at the cutting member first position and a second position at which the cutting member 22 extends generally along the longitudinal axis 14. The first position is shown by solid lines and the second position is shown by broken lines.

A controlling system 24 is connected to the pole 11 and is adjustable between a first position, shown, at which the cutting member 22 is maintained at the cutting member first position and a second position, shown by broken lines, at which the cutting member 22 is released and pivotally moveable to the cutting member second position.

Referring to FIG. 1. in this embodiment of the controlling system 24, the cutting member 22 has a slot 26, and the controlling system has a holding member 28. A lever arm 30 is pivotally connected, by a bolt for example, to the handle 12.

A pulling element 32 extends between and is pivotally connected to the lever arm 30 and connected to the holding member 28. The holding member 28 is moveable in response to movement of the lever arm 30 between a first position at which the holding member is nesting within the cutting member slot 26 and a second position at which the holding member 28 is spaced from the cutting member slot 26. At the first position of the lever arm 30, the holding member 28 is maintaining the cutting member 22 at its first position and at the second position of the lever arm 30, the holding member 28 free from the slot and the cutting member 22 is moveable to its second position.

Figure 2A:
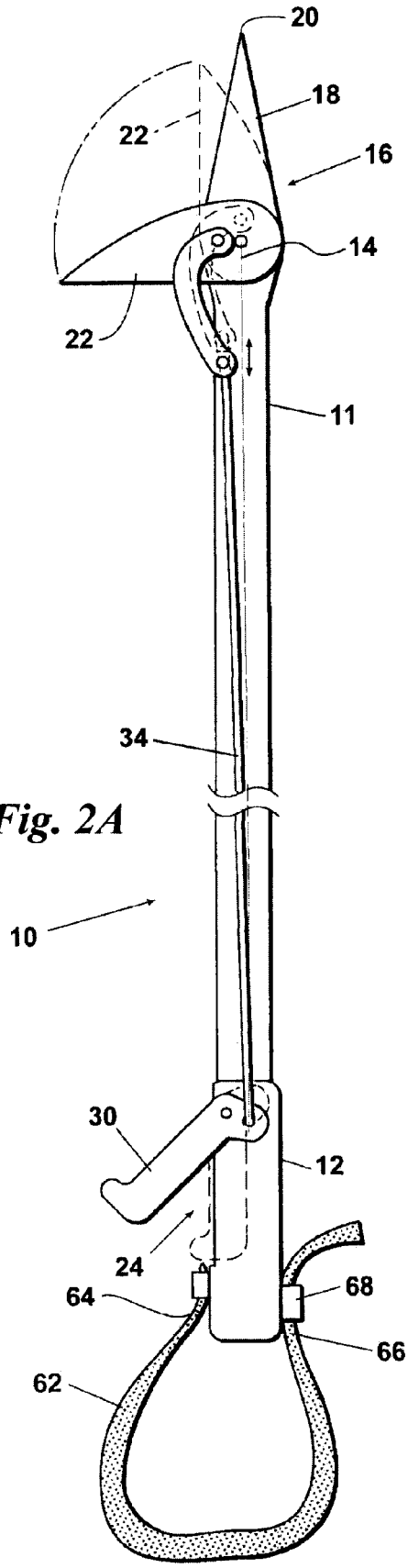
FIG. 2A is a side view of another embodiment of a pike pole of this invention.

The pole 11 is preferably a hollow fiberglass tube and the pulling element 32 can be a chain, rope, cord, cable or rod, preferably a fiberglass rod. However, the pole 11 can be formed of wood or organic plastic and the controlling system 24 placed outside the pole 11 without departing from this invention, as shown in FIG. 2A.

At the first position of the cutting member 22, the pike pole 10 can be stabbed into roofing material and siding, rotated, and then pulled to cut and remove pieces of the roof and siding in order to gain access to the inside of a building. When, as sometimes happens, the cutting member 22 becomes hung within the building on wires, bolts or other structure and the pike pole cannot be pulled from the structure for further present use. In such situations, heretofore utilized pike poles would have to be abandoned and other pike poles obtained in order to continue with the work. In the apparatus of this invention, the cutting element can be moved to its second position which will free it from entrapment by wires, bolts or other structure and the pike pole can be recovered, the cutting member 22 moved to the first position and the pike pole be structured for further immediate use. Therefore, this invention's use will save considerable time, labor, equipment, and natural resources.

FIG. 2 shows another embodiment of the controlling system 24 of the apparatus of this invention wherein a pushing element 34, such as a rod for example, extends between the lever arm 30 and the cutting member 22. In this embodiment, the pushing element 34 is connected to the lever arm 30 and the cutting member 22 each at a location spaced from their respective pivot connections. In this embodiment, the lever arm is preferably of a "dog leg" configuration to form a lever arm 30 that is more comfortable to operate. It should also be noted that the end of the pushing element 34 adjacent the cutting member 22 extends through a slot 36 of the pole 11 and provides a greater mechanical advantage for movement of the cutting member 22.

Figure 4:
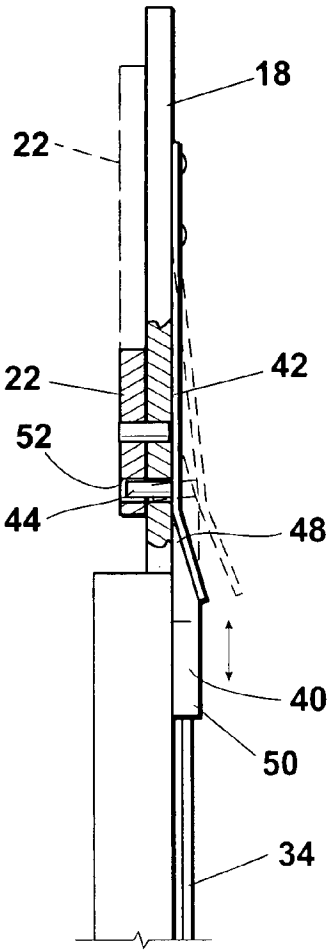
FIG. 4 is a side view of the pike pole portion of FIG. 3.
Figure 3:
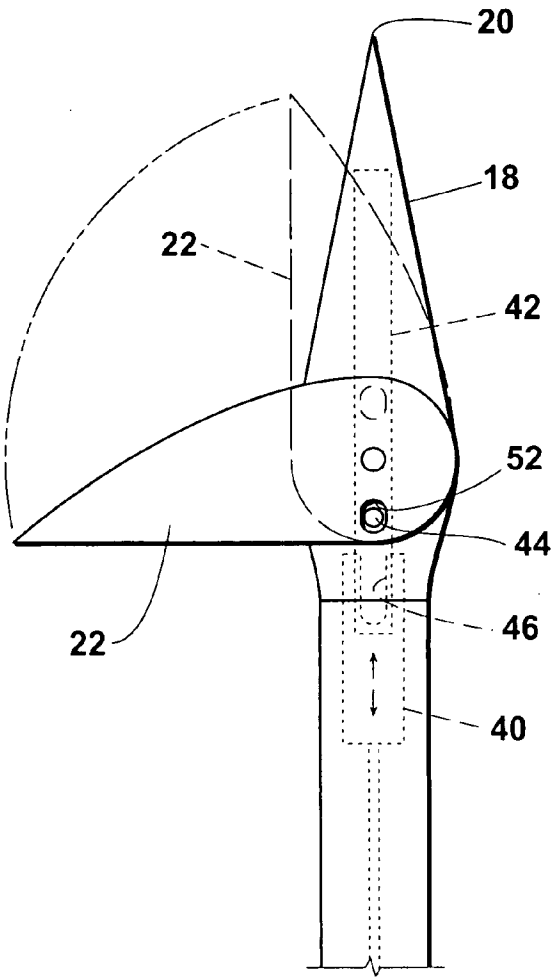
FIG. 3 is a plan view of yet another embodiment of a portion of the pike pole of this invention.

FIGS. 3 and 4 show yet another embodiment of the controlling system 24 wherein a pushing element 34 extends from the lever arm 30 which in this embodiment is similar to the lever arm shown in FIG. 2. In this embodiment of FIGS. 3 and 4, the controlling system 24 has a lever arm 30 of a construction similar to that shown in FIG. 2 with a pushing element 34 connected at one end to the lever arm 30 and at the other end to a wedge 40. A leaf spring 42 is connected on one end to the first element 18 and the other end has a pin extending transversely and outwardly from the plane of the leaf spring 42.

The wedge 42 has first and second portions 48,50 a longitudinal axis and a grove 46 extending along the axis of the pushing element 34 and wedge 40. The wedge 40 is slidably moveable toward and from the leaf spring 42 in response to movement of the lever arm 30. In the normal locked or first position of the cutting member 22, the pin 44 of the leaf spring 42 is positioned within an opening 52 of the cutting member and the pin 44 is positioned within the wedge groove 46 thereby maintaining the cutting member 22 at the first position. When the lever arm 30 is actuated, the second portion 50 of the wedge 40 is pushed under the leaf spring 42 resulting in the leaf spring pin 44 being removed from the cutting member opening 52 thereby releasing the cutting member 22 for movement to the second position. It should be noted that the pin 44 passes through an opening 45 of the first element 18 and into the cutting member opening 52 at the first position of the cutting member 22.

Figure 5:
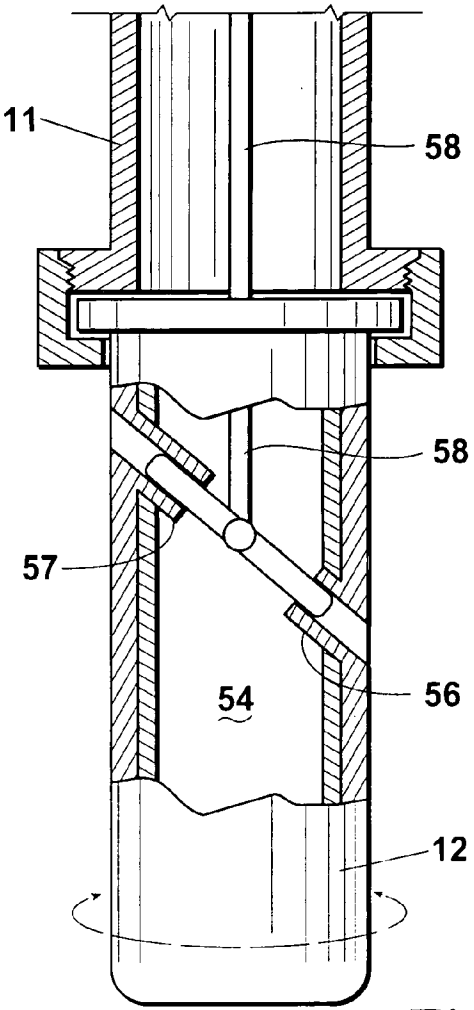
FIG. 5 is another embodiment of a portion of the controlling system of this invention.

Referring to FIG. 5, the controlling system of this embodiment has a handle 12 which is rotatably connected to the pole 11. The rotatable handle has a chamber 54. The chamber 54 has grooves 56,57 on opposed sides of the tube 54. The grooves 56,57 are angled relative the longitudinal axis 14. One end of a rod 58, which becomes a pushing and pulling element of this embodiment, is bifurcated and the bifurcated ends extend into the grooves 56,57. Therefore as the handle is turned one way or the other, the lead of the grooves 56,57 causes the rod 58 to respectively push or pull on the cutting member 22 and move it to its various positions.

Figure 6:
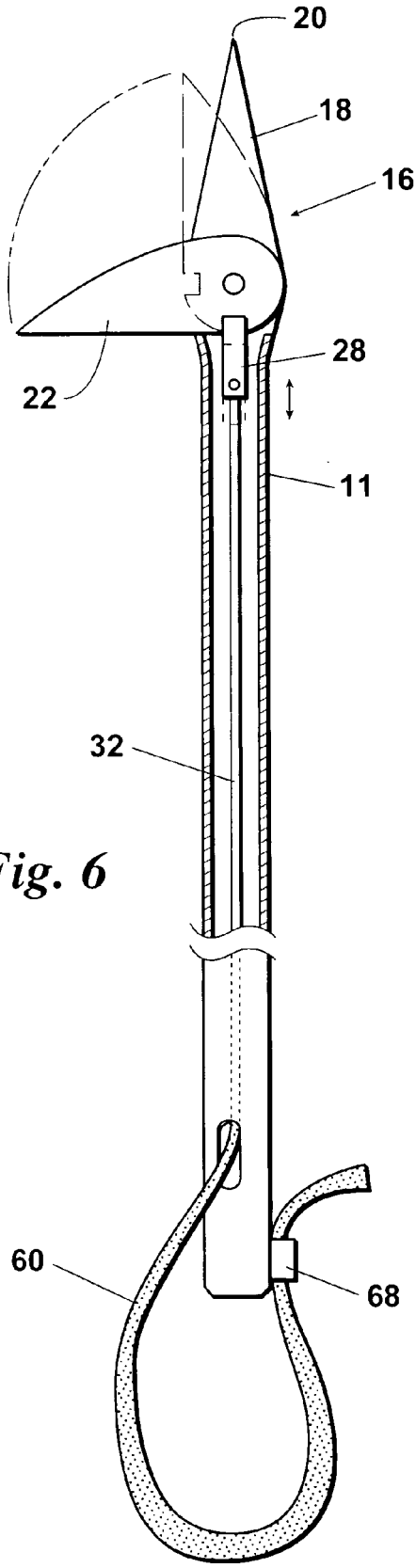
FIG. 6 is yet another embodiment of a portion of the controlling system of this invention.

FIG. 6 shows another embodiment of the pike pole 10 of this invention whose controlling system 24 has a pulling element 32 which extends beyond the pike pole handle 12 and defines an adjustable loop 60. The adjustable loop can also be used to step on and assist in pulling the pike pole from overhead structure in addition to releasing the cutting member 22. The cutting member 22 can also be released by pulling on the pulling element 32 by hand. It should be understood that, without departing from this invention, the pulling element 32 can be separate from the loop element 62 with both end portions 64,66 of the loop element 62 connected to the handle 12, as more fully described below.

Figure 7:
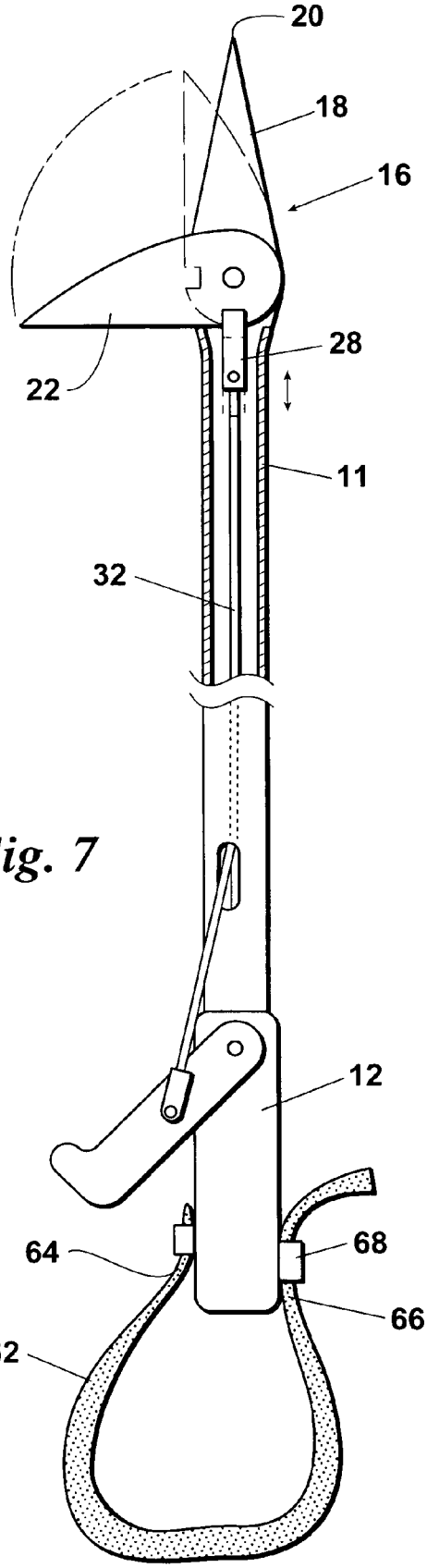
FIG. 7 is another portion of the pike pole of this invention.

FIG. 7 shows a pike pole 10 of this invention wherein an adjustable loop element 62 is connected to the handle 12. The loop element 62 has first and second end portions 64,66. The first end portion 64 is fixedly connected to the handle 12 and the second end portion 66 is adjustably connected to a buckle 68 which is fixedly connected to the pike pole handle 12. This adjustable loop element 62 can be utilized on any of the pike pole embodiments of this invention to assist in using the pike pole, as set forth above.

The loop element 63 can be formed of any material that will withstand the forces that can be subjected thereupon by an individual. Preferably, the loop element 63 is formed of Nylon.

The invention claimed is:

1. In a pike pole used in fire rescue having a shaft that includes a first half and a second half, a handle connected to one end of the shaft that is located on the first half of the shaft, a longitudinal axis, and a cutting-piercing member connected to the other end of the shaft that is located on the second half of the shaft, said cutting-piercing member having a first element extending along the longitudinal axis and having a pointed tip that is located substantially on the longitudinal axis and that points in a direction that is parallel to the longitudinal axis, the improvement comprising:

an elongated cutting member pivotally connected to the first element and being controllably moveable between a first laterally-oriented position at which the cutting member includes an edge that is located along at least half a length of the cutting member, is oriented substantially perpendicular to the longitudinal axis, and extends further from the longitudinal axis than any other member on the second half of the shaft while forming an opened relationship with the first element, and a second longitudinally-oriented position at which the cutting member extends generally along the longitudinal axis and forming a closed relationship with the first element, the first laterally-oriented position of the cutting member enabling a thrusting and cutting of the pike pole through a building structure followed by a rotating and removal of the pike pole in order to remove portions of the building structure using the edge of the cutting member, and the second longitudinally-oriented position of the cutting member facilitating an extraction of the pike pole from the building structure in response to the edge of the cutting member preventing the removal of the pike pole from the building structure when the cutting member is in the first laterally-oriented position; and a controlling system connected to the handle and being adjustable between a first position at which the cutting member is maintained at the cutting member first laterally-oriented position and in the opened relationship with the first element, and a second position at which the cutting member is released and pivotally moveable to the cutting member second longitudinally-oriented position and in the closed relationship with the first element;

wherein the controlling system comprises a lever arm pivotally connected to the handle and a pushing element extending between and pivotally connected to the lever arm and the cutting member, said pushing element being moveable towards the cutting member and away from the handle, in response to movement of the lever arm, between a first position at which the cutting member is maintained at the cutting member first laterally-oriented position forming the open relationship with the first element, and a second position at which the movement of the pushing element towards the cutting member and away from the handle moves the cutting member to the second longitudinally-oriented position in which the cutting member forms the closed relationship with the first element.

2. The pike pole, as set forth in claim 1, wherein the cutting member has a slot and the controlling system has a holding member, including:

a pulling element connected to the holding member and to the handle and forming an adjustable loop longitudinally extending beyond the handle, said holding member being moveable, in response to movement of the pulling element, between a first position at which the holding member is nested within the cutting member slot and a second position at which the holding member is spaced from the cutting member slot.

3. The pike pole, as set forth in claim 1, wherein the cutting member has a slot and the controlling system has a holding member, a lever arm pivotally connected to the handle, and a pulling element extending between and connected to the lever arm and the holding member, said holding member being moveable, in response to movement of the lever arm, between a first position at which the holding member is nested within the cutting member slot and a second position at which the holding member is spaced from the cutting member slot.

4. The pike pole, as set forth in claim 3, including a loop element having first and second end portions, said first end portion being fixedly connected to the pike pole handle and the second end portion being adjustably connected to a buckle fixedly connected to the pike pole handle.

5. The pike pole, as set forth in claim 1, including a flexible loop element having first and second portions that are directly coupled to the pike pole handle- and that allow the flexible loop element and to be adjustable.

6. The pike pole, as set forth in claim 1, wherein the lever arm is of an angular configuration and the pushing element is connected to the lever arm at a spaced distance from the pivotal connection of the lever arm to the handle.

7. The pike pole, as set forth in claim 1, including a slot formed in the shaft adjacent the cutting-piercing member and said pushing element extending through said slot.

8. The pike pole, as set forth in claim 1, wherein said cutting member has an opening and the controlling member has a lever arm pivotally connected to the handle, a leaf spring connected to the first element and extending over the cutting member opening, a holding member connected to the leaf spring and being extendable into the cutting member opening, a wedge having a longitudinal axis, first and second portions and a slot formed along said axis, said slot being of a size sufficient for receiving said holding member, and a push rod connected to the wedge and to the lever arm, said wedge being slidably moveable, in response to movement of the lever arm, between a first position at which a lesser portion of said wedge is positioned between the leaf spring and the cutting member and the holding member is positioned within said cutting member opening and a second position at which a greater portion of said wedge is position between said leaf spring and the cutting member, said leaf spring is positioned away from said cutting member and said holding member is cleared from said cutting member opening.

9. The pike pole, as set forth in claim 8, including a loop element having first and second end portions, said first end portion being fixedly connected to the pike pole handle and the second end being adjustably connected to a buckle fixedly connected to the pike pole handle.

10. The pike pole, as set forth in claim 1, wherein the controlling system includes a rotatable handle and an actuating rod connected to the handle and being telescopically moveable relative to the handle in directions toward and from the cutting-piercing member in response to rotation of the handle.

11. The pike pole, as set forth in claim 10, including a loop element having first and second end portions, said first end portion being fixedly connected to the pike pole handle and the second end portion being adjustably connected to a buckle fixedly connected to the pike pole handle.

12. The pike pole, as set forth in claim 1, wherein at least one of the handle and the shaft is designed to conceal at least a portion of the controlling system.

13. The pike pole, as set forth in claim 1, wherein a portion of the controlling system is designed to be at least partially concealed within at least one of the handle and the shaft.

14. The pike pole, as set forth in claim 1, wherein at least one of the lever arm and the pushing element is at least partially concealed within at least one of the handle and the shaft.

15. The pike pole, as set forth in claim 1, wherein the controlling system is coupled externally to the pike pole.

16. The pike pole, as set forth in claim 15, wherein the pushing element comprises a push rod, the push rod slidably coupled along an exterior surface of the shaft, and the lever arm pivotally coupled to an exterior surface of the handle.

17. The pike pole, as set forth in claim 16, further comprising a loop element having first and second end portions, said first end portion being fixedly connected to the pike pole handle and the second end portion being adjustably connected to a buckle fixedly connected to the pike pole handle, the loop element configurable to be used as a boot stirrup for a rescue worker to step on in order to free the pike pole from an overhead structure.

18. The pike pole, as set forth in claim 1, wherein at least one of the lever arm and the pushing element is coupled externally to at least one of the handle and the shaft.

19. A fire rescue tool used to penetrate and tear down building structures comprising:

an elongated shaft having a first half and a second half, a longitudinal axis, a handle at a proximal end on the first half of the shaft, and a first cutting-piercing element extending substantially parallel to the longitudinal axis and having a pointed tip that points in a direction that is parallel to the longitudinal axis of the shaft at a distal end on the second half of the shaft;

a second cutting-piercing element pivotally coupled to the distal end of the shaft, the second cutting-piercing element being controllably moveable between a first laterally-oriented position at which the second cutting-piercing element includes an edge that is located along at least half a length of the cutting member, is oriented substantially perpendicular to the longitudinal axis, and extends further from the longitudinal axis than any other member on the second half of the shaft while forming an opened relationship with the first cutting-piercing element, and a second longitudinally-oriented position at which the second cutting-piercing element extends generally along the longitudinal axis and forming a closed relationship with the first cutting-piercing element, the first laterally-oriented position of the second cutting-piercing element enabling a thrusting and cutting of the pike pole through a building structure followed by a rotating and removal of the pike pole in order to remove portions of the building structure using the edge of the cutting member, and the second longitudinally-oriented position of the second cutting-piercing element facilitating an extraction of the pike pole from the building structure in response to the edge of the cutting member preventing the removal of the pike pole from the building structure when the cutting member is in the first laterally-oriented position; and a controlling system coupled to the handle and actuating the second cutting-piercing element between the first laterally-oriented position and in the opened relationship with the first cutting-piercing element, and the second longitudinally-oriented position and in the closed relationship with the first cutting-piercing element.

* * * * *